US010711428B2

(12) United States Patent
Li et al.

(10) Patent No.: US 10,711,428 B2
(45) Date of Patent: Jul. 14, 2020

(54) SUPPORTING DEVICE AND METHOD FOR CALCULATING JACKING FORCE THEREOF

(71) Applicant: China Construction Steel Structure Corp. Ltd., Shenzhen (CN)

(72) Inventors: Chuntian Li, Shenzhen (CN); Biao Liao, Shenzhen (CN); Weizheng Kong, Shenzhen (CN); Xinyu Shao, Shenzhen (CN); Siyuan Zhao, Shenzhen (CN); Xiaoyong Wen, Shenzhen (CN); Yangyang Sun, Shenzhen (CN)

(73) Assignee: CHINA CONSTRUCTION STEEL STRUCTURE CORP. LTD., Shenzhen (CN)

( * ) Notice: Subject to any disclaimer, the term of this patent is extended or adjusted under 35 U.S.C. 154(b) by 174 days.

(21) Appl. No.: 15/769,266

(22) PCT Filed: Jul. 6, 2016

(86) PCT No.: PCT/CN2016/088791
§ 371 (c)(1),
(2) Date: Jul. 16, 2018

(87) PCT Pub. No.: WO2017/045460
PCT Pub. Date: Mar. 23, 2017

(65) Prior Publication Data

US 2019/0078341 A1 Mar. 14, 2019

(30) Foreign Application Priority Data

Sep. 16, 2015 (CN) ..... 2015 1 0591657

(51) Int. Cl.
*E02D 35/00* (2006.01)
*E02D 37/00* (2006.01)
*E04G 25/06* (2006.01)

(52) U.S. Cl.
CPC ..... *E02D 35/005* (2013.01); *E02D 37/00* (2013.01); *E04G 25/065* (2013.01)

(58) Field of Classification Search
CPC ... E04G 11/483; E04G 25/065; E02D 35/005; E02D 37/00
See application file for complete search history.

(56) References Cited

U.S. PATENT DOCUMENTS 3,742,662 A * 7/1973 Ballou ..... E04G 1/14 52/126.7
4,122,645 A * 10/1978 Tooley ..... E04G 11/486 52/651.1

(Continued)

FOREIGN PATENT DOCUMENTS

CA 2184241 A1 * 2/1998 ..... E04G 25/065
CN 204590654 8/2015

(Continued)

OTHER PUBLICATIONS

"International Preliminary Report on Patentability," for PCT Application No. PCT/CN2016/088791 dated Mar. 30, 2018 (8 pages). English Translation.

(Continued)

*Primary Examiner* — Michael Safavi
(74) *Attorney, Agent, or Firm* — Whiteford, Taylor & Preston, LLP; Peter J. Davis

(57) ABSTRACT

A lightweight multifunctional supporting device and a method for calculating a jacking force thereof. The lightweight multifunctional supporting device includes a supporting frame and a jacking device, the jacking device includes a screw rod and a jacking seat, the screw rod (21) is provided vertically and is fixed on the supporting frame, the jacking seat is provided thereon with a vertical threaded hole and is provided with a lateral rotation rod, and the screw (Continued)

rod is in threaded connection with the threaded hole. The method for calculating the jacking force of the supporting device above.

8 Claims, 11 Drawing Sheets

(56) References Cited

U.S. PATENT DOCUMENTS

| | | | | | |
|---|---|---|---|---|---|
| 5,031,724 | A * | 7/1991 | Quinn | E04G 11/48 | 182/186.6 |
| 5,120,163 | A * | 6/1992 | Holdeman | E02D 27/48 | 405/229 |
| 5,171,107 | A * | 12/1992 | Hamilton | E02D 27/48 | 405/229 |
| 5,232,204 | A * | 8/1993 | Nunez | E04G 25/065 | 254/133 A |
| 5,819,482 | A * | 10/1998 | Belke | E04C 3/005 | 52/126.6 |
| 6,256,939 | B1 * | 7/2001 | Snyder | E04D 11/007 | 52/126.6 |
| 2002/0141811 | A1 * | 10/2002 | Shih | E04G 7/12 | 403/49 |
| 2003/0012607 | A1 * | 1/2003 | Coday | E04G 11/38 | 405/272 |
| 2005/0000171 | A1 * | 1/2005 | McCracken | E04G 11/48 | 52/169.9 |
| 2011/0020068 | A1 * | 1/2011 | Kelly | E02D 27/34 | 405/230 |
| 2016/0032953 | A1 * | 2/2016 | Papadopoulos | E04G 25/065 | 248/188.4 |

FOREIGN PATENT DOCUMENTS

| | | | | |
|---|---|---|---|---|
| CN | 204590657 | | 8/2015 | |
| CN | 105178626 | | 12/2015 | |
| DE | 3641349 | A1 * | 6/1988 | E04G 25/065 |
| DE | 102012211384 | A1 * | 1/2014 | E04G 11/38 |
| EP | 0346524 | A2 * | 12/1989 | E04G 1/24 |
| EP | 0549359 | | 6/1993 | |
| EP | 1398432 | A2 * | 3/2004 | E04G 11/38 |
| EP | 2679746 | A1 * | 1/2014 | E04G 25/065 |
| FR | 859065 | A * | 12/1940 | E04G 25/06 |
| FR | 2903135 | A1 * | 1/2008 | E04G 11/48 |
| FR | 3005084 | A1 * | 10/2014 | E04G 11/48 |
| FR | 3008119 | A1 * | 1/2015 | E04G 5/02 |
| GB | 607377 | A * | 8/1948 | E04G 25/04 |
| GB | 1279617 | A * | 6/1972 | F16B 7/10 |
| JP | 52026730 | A * | 2/1977 | E04G 25/061 |
| JP | H0747887 | B2 * | 5/1995 | E04G 25/065 |
| WO | 207045460 | | 4/2018 | |

OTHER PUBLICATIONS

"International Search Report and Written Opinion," for PCT Application No. PCT/CN2016/088791 dated Oct. 13, 2016 (9 pages). English Translation.

* cited by examiner

SUPPORTING DEVICE AND METHOD FOR CALCULATING JACKING FORCE THEREOF

CROSS-REFERENCE TO RELATED APPLICATIONS

This application is a national stage application under 35 U.S.C. 371 of International Patent Application Serial No. PCT/CN2016/088791, entitled "Lightweight Multifunctional Supporting Device and Method for Calculating Jacking Force thereof," filed Jul. 6, 2016, which claims priority from Chinese Patent Application No. CN 201510591657.4, filed Sep. 16, 2015, the disclosure of which is incorporated herein by reference.

TECHNICAL FIELD

The present disclosure relates to the technical field of building construction, and particularly to a lightweight multifunctional supporting device and a method for calculating a jacking force thereof.

BACKGROUND ART

In the construction process of a number of building structures, relatively heavy construction equipment or hoisting crane need to be borne, and such large construction loads often exceed a permissible use load according to the design. Therefore, the buildings need to be reinforced temporarily by some reinforcement measurements. After the construction is completed, the reinforcement measurements will be removed. At present, the reinforcement measurements are generally associated with problems such as complex structure, poor universality, complicated installation and removal processes. The most critical problem would be an insufficient jacking between the reinforcement measurements and the structures. In the construction process, construction workers cannot precisely determine the jacking degree applied to the building structure as required by the design, and can only roughly estimate according to their own experience or convenience. As a result, phenomena of construction gaps or excessive jacking are largely present, which renders the reinforcing effect and the design requirement discrete. If a jacking force is too large or too small, serious adverse impact will occur against the safety of the building, resulting in cracking of the structure or even damage and collapse of the building.

CONTENT OF THE DISCLOSURE

Technical Problem

A technical problem to be solved by the present disclosure is to provide a lightweight multifunctional supporting device and a method for calculating a jacking force thereof, aiming at solving the problems of complex structure, complicated installation and removal, and imprecise jacking force applied to the building as present in the temporary supporting and reinforcing facilities of the prior art.

Solutions to the Problems

Technical Solutions

The present disclosure is realized as follows: a lightweight multifunctional supporting device, including a supporting frame and a jacking device, the jacking device including a screw rod and a jacking seat, wherein the screw rod is provided vertically, and is fixed on the supporting frame, wherein the jacking seat is provided thereon with a vertical threaded hole and is provided with a lateral rotation rod, wherein a top of the jacking seat is planar, and the screw rod is in threaded connection with the threaded hole.

Furthermore, the supporting frame further includes a first fixing flange, and a bottom of the screw rod is fixedly connected to the supporting frame through the first fixing flange.

Furthermore, the jacking device further includes a locking nut, the locking nut is sleeved on the screw rod, and is located between the first fixing flange and the jacking seat.

Furthermore, the supporting frame includes at least one standard supporting frame, the standard supporting frame includes at least four standard main upright rods distributed at four corners of the standard supporting frame, at least two standard lateral rods, a plurality of standard inclined rods, and first connecting elements that are fixed at two ends of the standard main upright rods, wherein the standard main upright rods are provided vertically, the standard lateral rods are provided horizontally, and two ends of the standard main upright rods are each fixedly connected to two adjacent standard main upright rods; the standard inclined rods have one end fixed on a top of one standard main upright rod, and have the other end fixed on a bottom of another standard main upright rod adjacent to said one standard main upright rod, and two standard main upright rods that are adjacent to each other in upper and lower position are removably connected through the first connecting element.

Furthermore, the supporting frame further includes a top supporting frame, the top supporting frame is provided on the standard supporting frame; the top supporting frame includes top main upright rods distributed at four corners of the standard supporting frame, at least two top lateral rods, a plurality of top inclined rods and second connecting elements that are fixed at two ends of the top main upright rod, wherein the top main upright rods are provided vertically, the top lateral rods are provided horizontally, and two ends of the top lateral rods are fixedly connected to two adjacent top main upright rods; the top inclined rods have one end fixed on a top of one top main upright rod, and have the other end fixed on a bottom of another top main upright rod adjacent to the one top main upright rod, wherein the second connecting element on a top of the top main upright rod is removably connected to the screw rod, and the second connecting element on a bottom of the top main upright rod is removably connected to the first connecting element on the top of the standard main upright rod.

Furthermore, the supporting frame further includes an adjustment rod provided between the standard supporting frame and the top supporting frame, wherein upper and lower ends of the adjustment rod are both provided with a second fixing flange, and the standard supporting frame and the top supporting frame are connected through the second fixing flange.

Furthermore, the lightweight multifunctional supporting device further includes a supporting base, and the supporting base is sandwiched between the jacking seat and a bottom face of the building.

The present disclosure further provides a method for calculating a jacking force of the lightweight multifunctional supporting device above, including the following steps:

A. pre-calculating a jacking force P needed to be applied to a position of a building in need of jacking according to design;

B. calculating a detection torque Tch=kPd by combining a pre-measured bolt torque coefficient k and a screw rod diameter d;

C. firstly screwing the screw rod into the jacking seat, and then mounting the screw rod on a top face of the supporting frame;

D. placing the lightweight multifunctional supporting device below the position of the building in need of jacking;

E. sheathing the rotational means capable of detecting the torque onto the rotation rod, such that the jacking seat is continuously moved upwards in a process of being screwed along the screw rod;

F. commencing to jack up the building when the jacking seat is moved upwards to a certain distance, wherein when a value of the torque detected by the rotational means is consistent with the detection torque Tch calculated above, the jacking force applied by the jacking seat to the position of the building is the jacking force P needed to be applied to the position of the building.

Beneficial Effects of the Disclosure

Beneficial Effects

The lightweight multifunctional supporting device of the present disclosure consists of the supporting frame, the screw rod and the jacking seat, which is simple in structure and convenient for installation and removal. The jacking seat can be moved upwards and jack the building simply by screwing the rotation rod on the jacking seat. Moreover, the jacking force of the jacking seat on the building can be determined to be the required jacking force P according to the detection torque Tch detected when the rotational means is rotated to a certain position. Accordingly, by using the supporting device and the method for calculating the jacking force of the present disclosure, a precise jacking force can be applied to the building, and can be precisely unified with design requirements, so as to guarantee the reinforcing effect to the greatest extent.

BRIEF DESCRIPTION OF DRAWINGS

Description of Drawings

Figure 1:
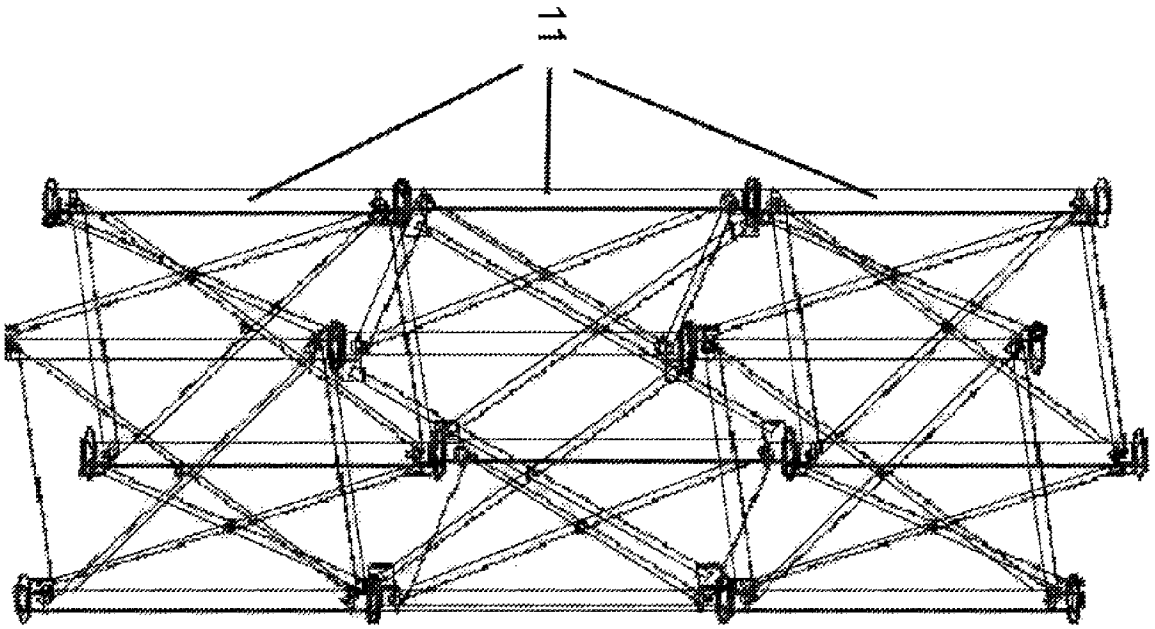

FIG. 1 is a perspective structural schematic view of a standard supporting frame provided in an embodiment of the present disclosure.

Figure 2:
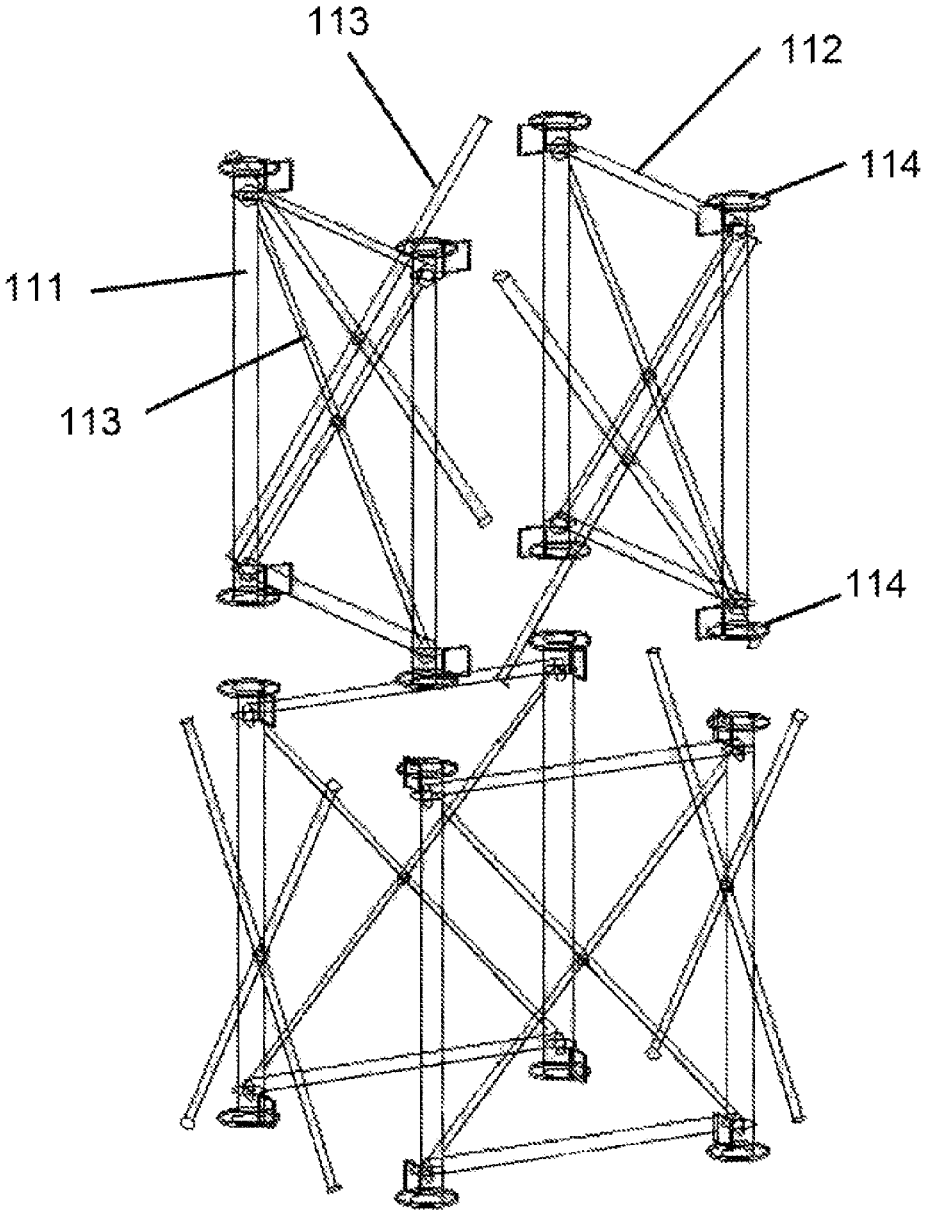

FIG. 2 is an exploded structural schematic view of the standard supporting frame shown in FIG. 1.

Figure 3:
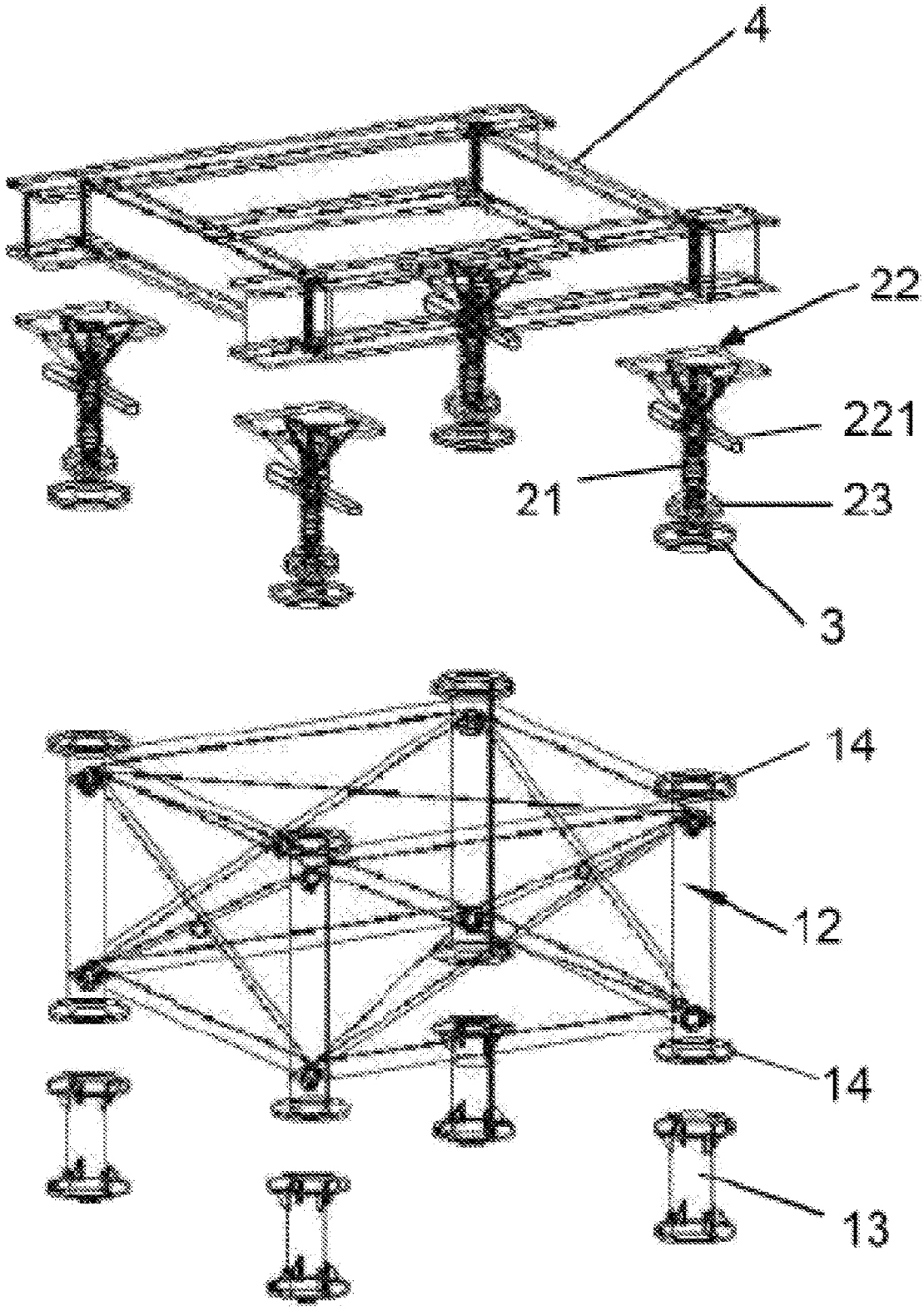

FIG. 3 is an exploded structural schematic view of a top supporting frame, a screw rod, a jacking seat and a supporting base provided in an embodiment of the present invention.

Figure 4:
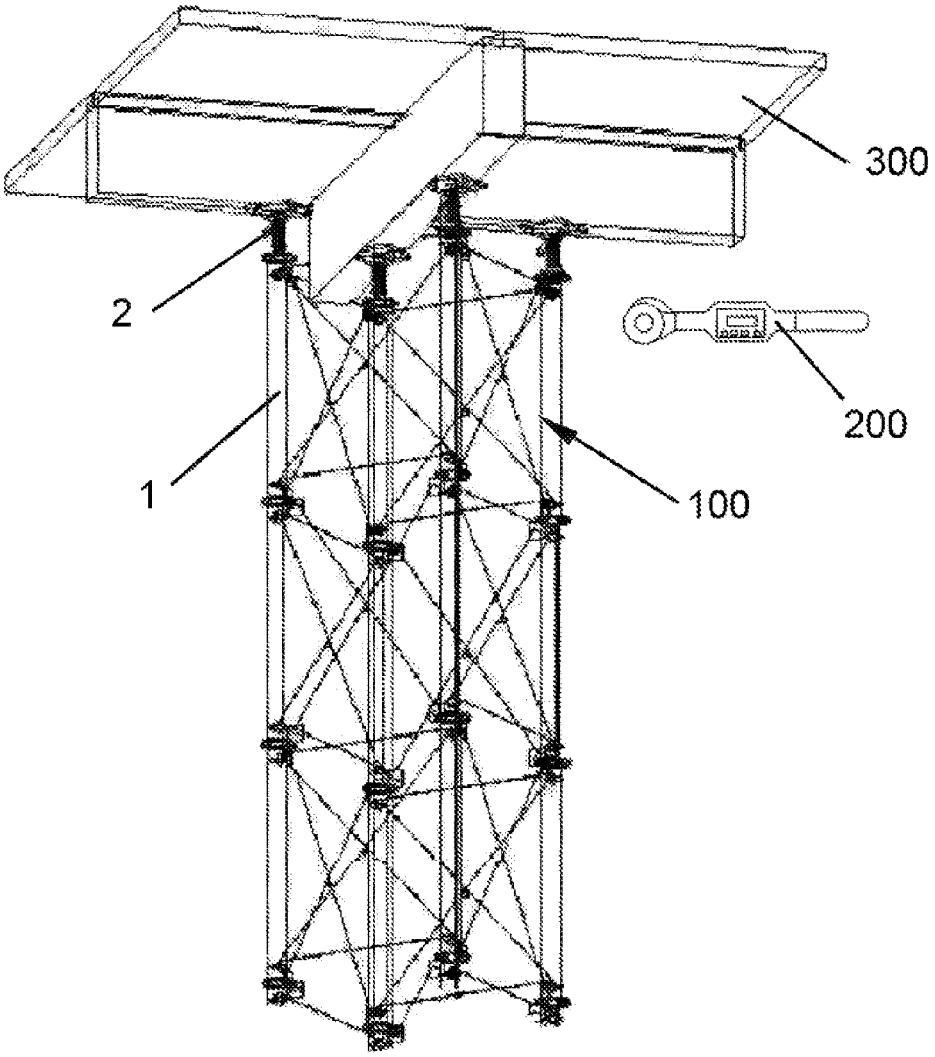

FIG. 4 is a perspective structural schematic view of the present embodiment after the supporting frame of the present embodiment is placed below a building and before the jacking seat is screwed with a rotational means.

Figure 5:
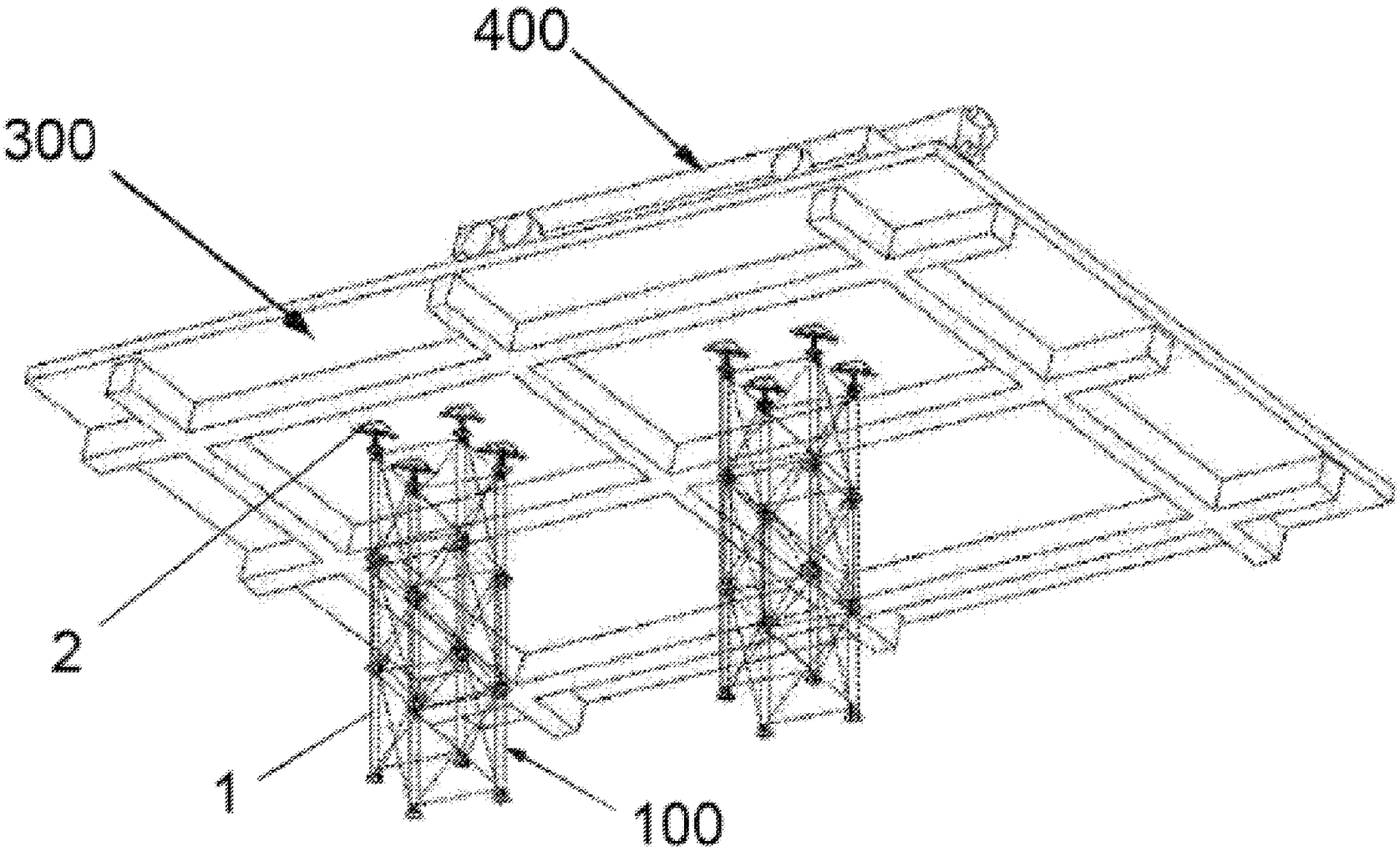

FIG. 5 is a perspective structural schematic view of using the lightweight multifunctional supporting device of the present embodiment to apply a jacking force to a bidirectional plate span.

Figure 6:
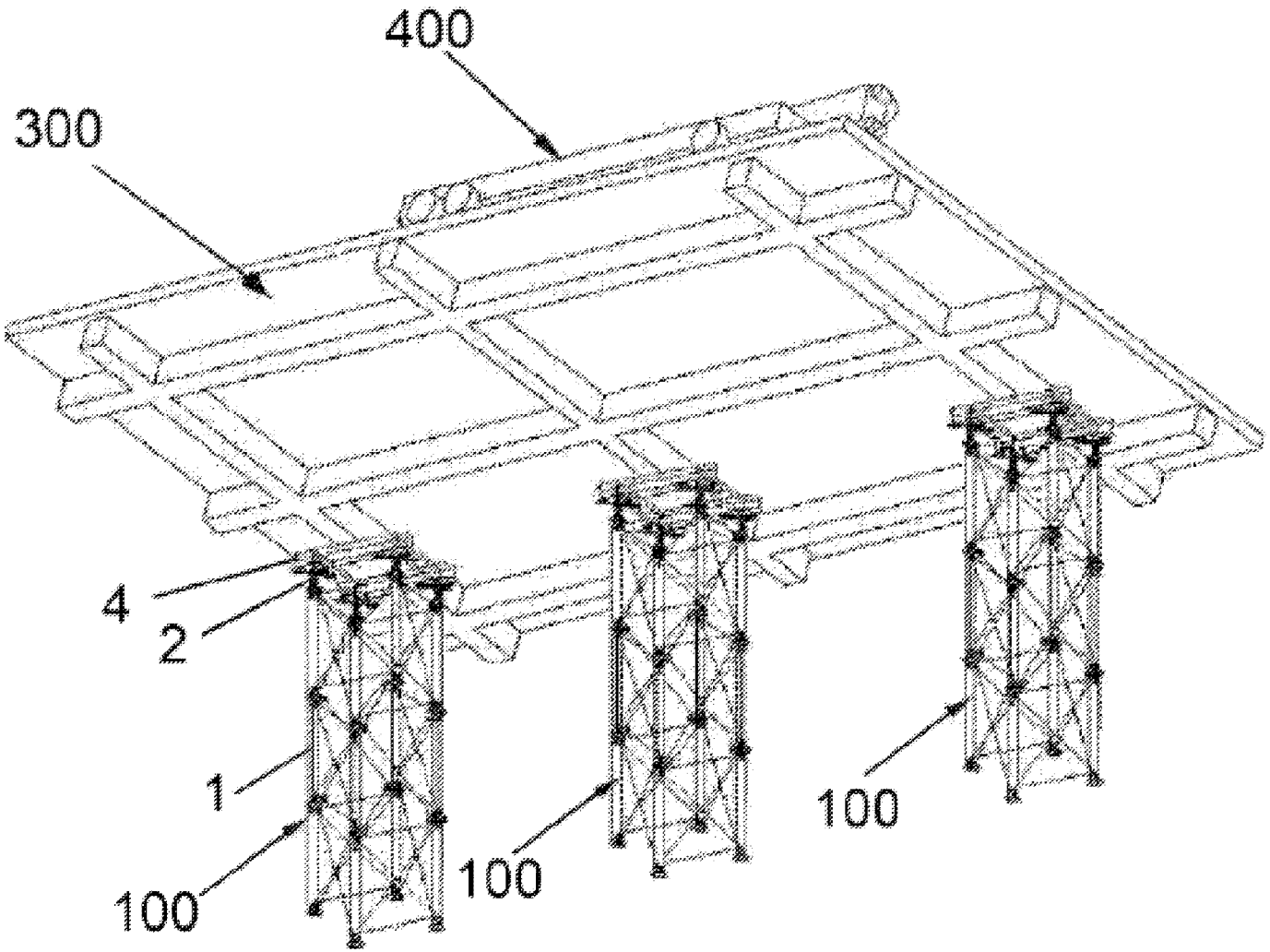

FIG. 6 is a perspective structural schematic view of using the lightweight multifunctional supporting device of the present embodiment to apply a jacking force to a beam span.

Figure 7:
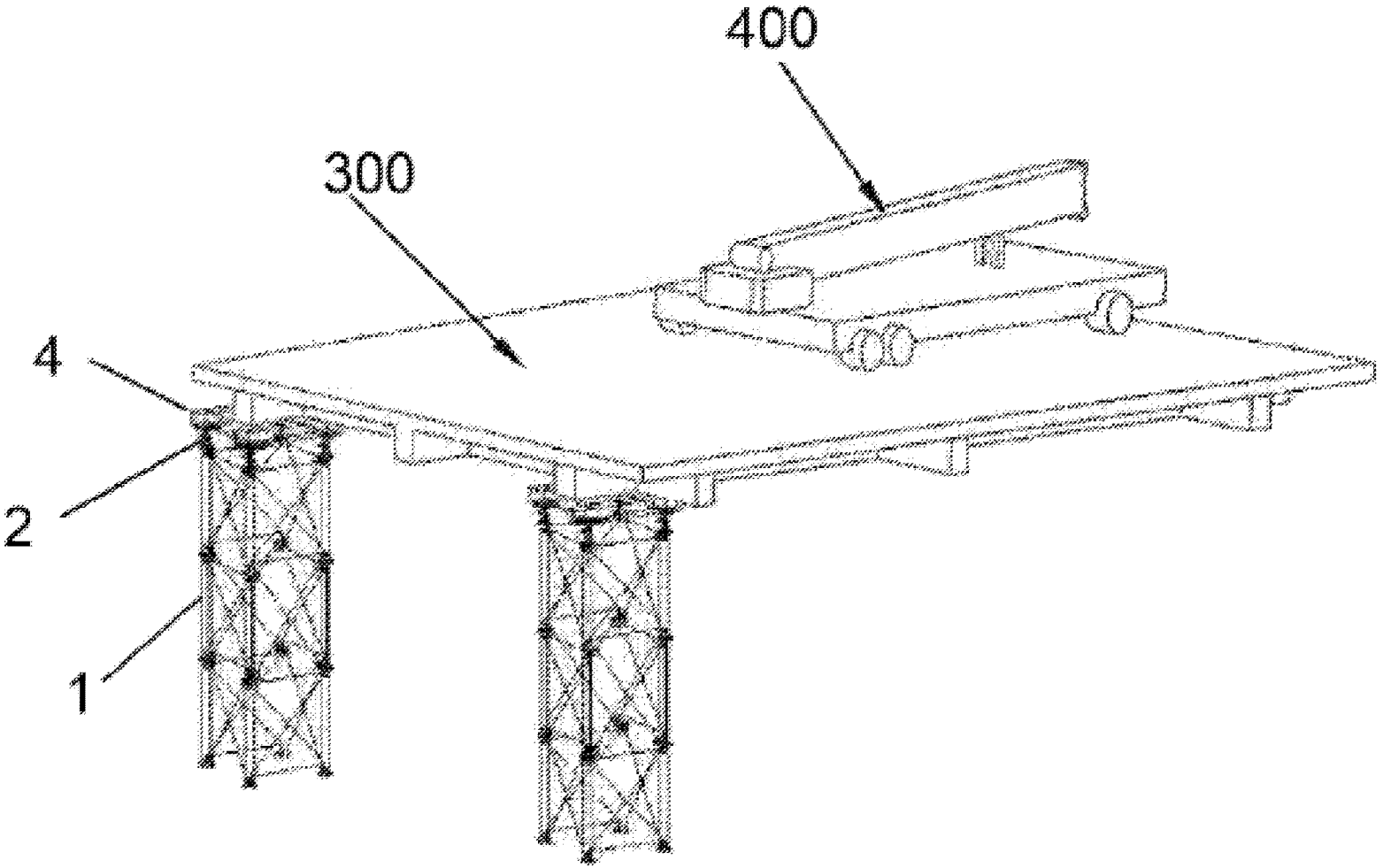

FIG. 7 is a perspective structural schematic view of using the lightweight multifunctional supporting device of the present embodiment to apply a jacking force to edge columns or corner columns.

Figure 8A:
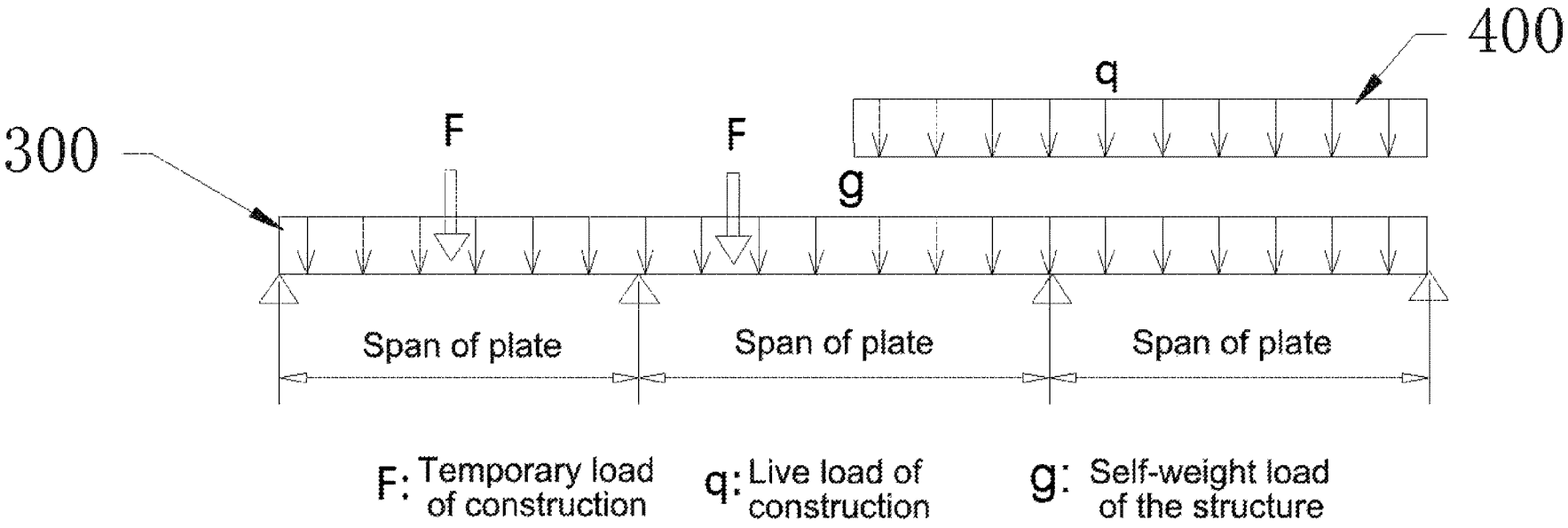
Figure 8B:
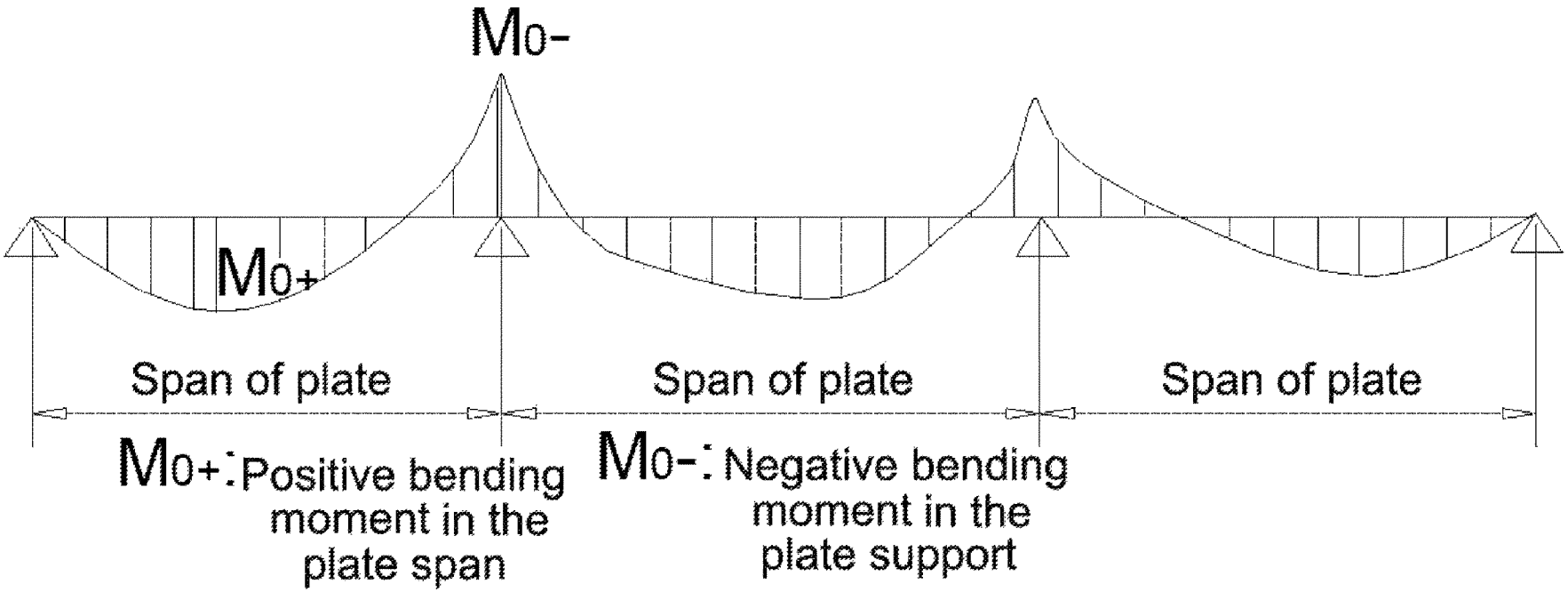

FIG. 8*a* and FIG. 8*b* are force analysis diagrams of a building before the lightweight multifunctional supporting device of the present embodiment is used to apply a jacking force.

Figure 9A:
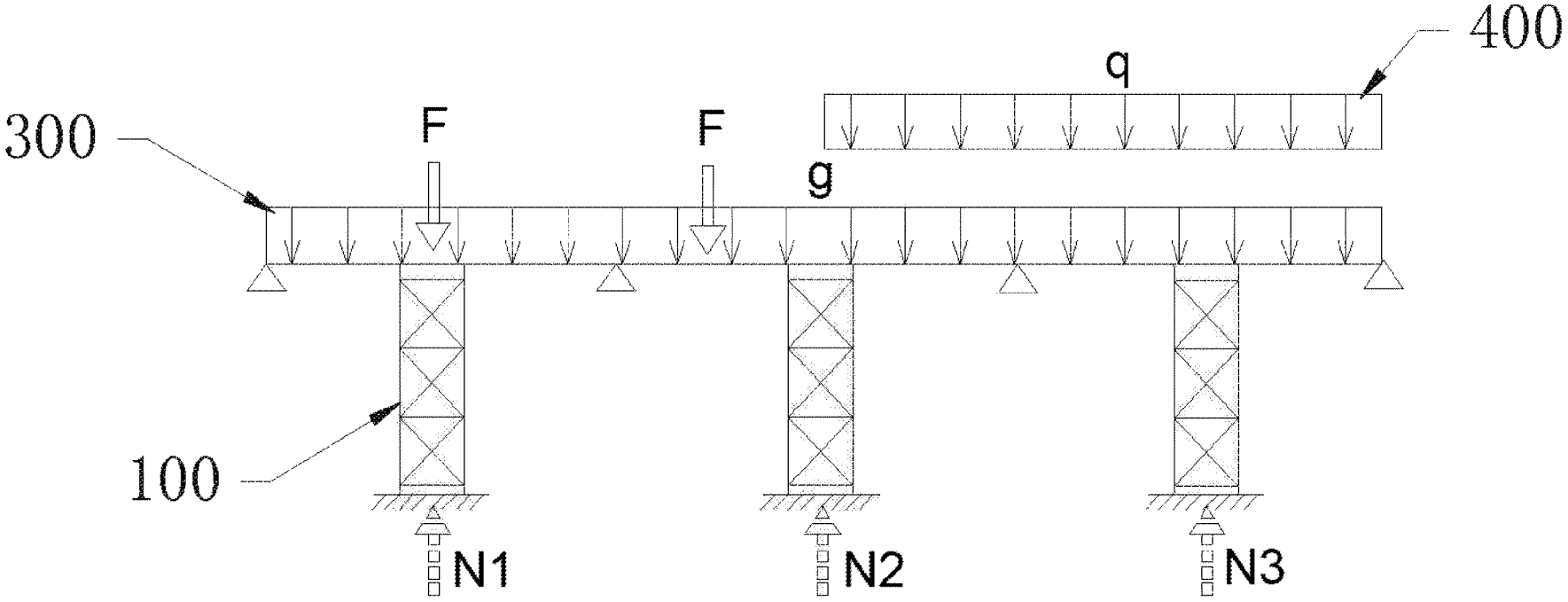
Figure 9B:
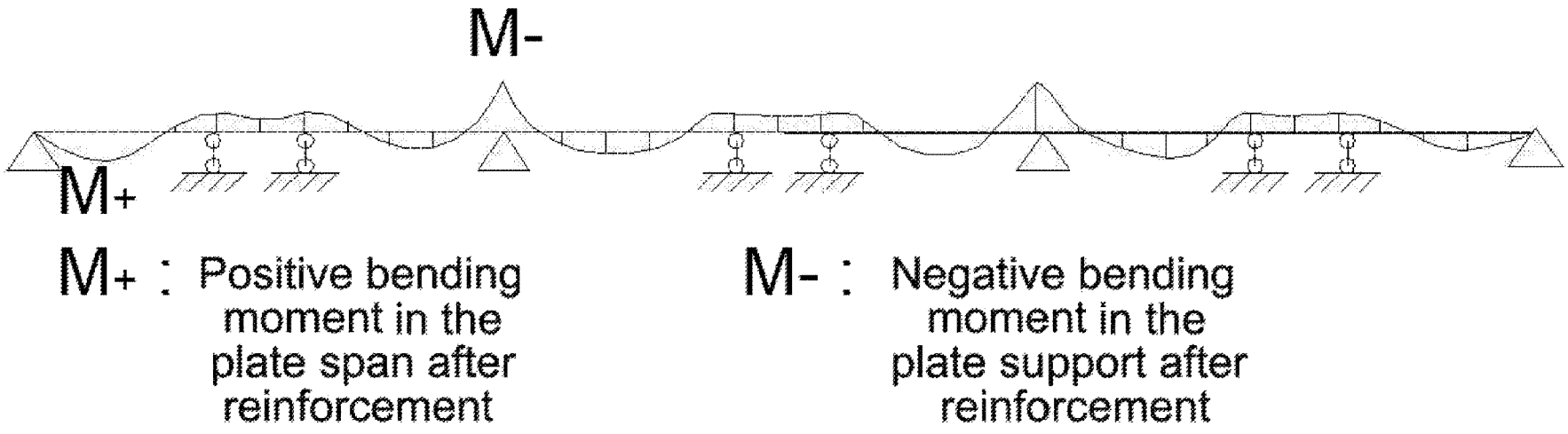

FIG. 9*a* and FIG. 9*b* are force analysis diagrams of a building after the lightweight multifunctional supporting device of the present embodiment is used to apply a jacking force.

EMBODIMENT OF THE DISCLOSURE

Detailed Description of Embodiments

In order to make the technical problem to be solved by the present disclosure, the technical solution and the beneficial effects clearer and understandable, the present disclosure is further described in detail below in conjunction with the figures and embodiments. It should be understood that the specific embodiments described herein are merely for explaining the present disclosure, rather than limiting the present disclosure.

As shown in FIG. 1 to FIG. 9*b*, the preferred embodiments of the present disclosure are shown. A lightweight multifunctional supporting device 100 includes a supporting frame 1, a jacking device 2, a first fixing flange 3 and a supporting base 4. The jacking device 2 includes a screw rod 21, a jacking seat 22 and a locking nut 23.

The screw rod 21 is provided in vertical direction. The bottom of the screw rod 21 is fixedly connected to the supporting frame 1 through the first fixing flange 3, so as to be fixed on the supporting frame 1. The jacking seat 22 is provided thereon with a vertical threaded hole (not shown in the figures) and is provided with a lateral rotation rod 221. The top of the jacking seat 22 is planar. The screw rod 21 is in threaded connection with the threaded hole. The rotation rod 221 is screwed by a rotational means 200 to move the jacking seat 22 upwards, and gradually jack a building 300.

The locking nut 23 is sleeved on the screw rod 21, and is located between the first fixing flange 3 and the jacking seat 22. The locking nut 23 is screwed so that the locking nut is positioned against the first fixing flange 3. In this way the screw rod 21 can be locked, such that the screw rod 21 remains stationary in the whole jacking process.

The supporting frame 1 of the present embodiment includes at least one standard supporting frame 11, one top supporting frame 12, and an adjustment rod 13 provided between the standard supporting frame 11 and the top supporting frame 12. Upper and lower ends of the adjustment rod 13 are both provided with a second fixing flange 14, and the standard supporting frame 11 and the top supporting frame 12 are connected through the second fixing flange 14. The supporting base 4 is sandwiched between the jacking seat 22 and a bottom face of the building 300. When a surface of the building 300 which needs to be jacked is unsmooth, the supporting base 4 can transmit its jacking force uniformly to the building 300.

The standard supporting frame 11 includes at least four standard main upright rods 111 that are distributed at four corners of the standard supporting frame 11, at least two standard lateral rods 112, several standard inclined rods 113, and first connecting elements 114 that are fixed at two ends of the standard main upright rods 111.

Specifically, referring to FIG. 1 and FIG. 2, the supporting frame 1 of the present embodiment includes 3 standard supporting frames 11, each standard supporting frame 11 includes four standard main upright rods 111 that are distributed at four corners of the standard supporting frame, four standard lateral rods 112, and eight standard inclined rods 113, wherein both upper and lower ends of two opposing side faces of the standard supporting frames 11 are each provided with one standard lateral rod 112, and four side faces are each provided with two standard inclined rods 113 that are arranged in cross. The standard main upright rods 111 are provided in vertical direction, and the standard lateral rods 112 are provided in horizontal direction. The two ends of the standard lateral rods 112 are each fixedly connected with two adjacent standard main upright rods 111. The standard inclined rod 113 have one end fixed on a top of a first standard main upright rod 111, and have the other end fixed on a bottom of another standard main upright rod 111 that is adjacent to the first standard main upright rod 111. The two standard main upright rods 111 that are adjacent to each other up and down are removably connected through the first connecting element 114.

The top supporting frame 12 is provided on the standard supporting frame 11. The top supporting frame 12 includes top main upright rods 121 that are distributed at four corners of the standard supporting frame 12, at least two top lateral rods 122, a plurality of top inclined rods 123, and second connecting elements 124 that are fixed at two ends of the top main upright rod 121.

Referring to FIG. 3, the top supporting frame 12 of the present embodiment includes four top main upright rods 121 distributed at four corners of the top supporting frame 12, eight top lateral rods 122, and eight top inclined rods 123, wherein both upper and lower ends of two opposing side faces of the top supporting frame 12 are each provided with a top lateral rod 122, and four side faces are each associated with two top inclined rods 123 that are in cross arrangement.

The top main upright rods 121 are provided in vertical direction, and the top lateral rods 122 are provided in horizontal direction. The two ends of the top lateral rods 122 are fixedly connected to the top main upright rods 121. The top inclined rods 123 have one end fixed on a top of a first top main upright rod 121, and have the other end fixed on a bottom of another top main upright rod 121 that is adjacent to said first top main upright rod 121. The second connecting element 124 on the top of the top main upright rod 121 is removably connected to the screw rod 21, and the second connecting element 124 on the bottom of the top main upright rod 121 is removably connected to the first connecting element 114 on the top of the standard main upright rod 121.

All of the first connecting elements 114 and the second connecting elements 124 as mentioned above can be constituted by flanges and associated bolt components thereof. In order to further reduce the weight of the supporting device, various rods of the supporting frame 1 as mentioned above can be manufactured by hollow tubes.

In practical application, the height of the above-mentioned top supporting frame 12 is usually smaller than the height of the standard supporting frame 11. Moreover, when the standard supporting frame 11 on the top of the supporting frame 1 has a relatively short distance from a position of the building 300 that needs to be jacked, the top supporting frame 12 can be omitted. The overall requirement for the height of the supporting frame 1 can be met by replacing the adjustment rod 13 with different lengths and/or using the supporting base 4.

Referring to FIG. 5 to FIG. 7, by using the supporting frame 1, the supporting base 4 and the adjustment rod 13 of the present embodiment in combination, a desired jacking force can be provided to different positions of the building 300, to the building 300 with various load bearings and to the building 300 with different heights.

Steps of using the above lightweight multifunctional supporting device 100 to calculate a magnitude of a jacking force applied by said device to the jacked building 300 are as follows:

A. calculating a jacking force P needed to be applied to a position of the building 300 in need of jacking;

B. calculating a detection torque Tch=kPd by combining a pre-measured bolt torque coefficient k and a screw rod diameter d;

C. firstly screwing the screw rod 21 into the jacking seat 22, and then mounting the screw rod 21 on a top face of the supporting frame 1;

D. placing the lightweight multifunctional supporting device 100 below the position of the building 300 in need of jacking;

E. sheathing the rotational means 200 that is capable of detecting the torque onto the rotation rod 221, such that the jacking seat 22 is continuously moved upwards in the process of being screwed along the screw rod 21;

F. starting to jack up the building 300 when the jacking seat 22 is moved upwards to a certain distance, wherein when a value of the torque detected by the rotational means 200 is consistent with the detection torque Tch calculated above, the jacking force applied by the jacking seat 22 at this position of the building 300 is the jacking force P needed to be applied to said position of said building 300;

G. screwing the locking nut 23 to prevent the screw rod 21 from loosening during the use of the multifunctional supporting device 100.

The above-mentioned bolt torque coefficient k is determined by the bolt itself, and it can be measured by existing experiment methods.

Accordingly, the lightweight multifunctional supporting device of the present embodiment is simple in structure and convenient for installation and removal. The jacking seat 22 can be moved upwards to jack the building 300 simply by screwing the rotation rod 221 on the jacking seat 22. It can be determined that the jacking force of the jacking seat 22 to the building 300 is the jacking force P needed based on the detection torque Tch detected when the rotational means 200 is rotated to a certain position.

Referring to the force analysis diagrams of the building before and after the jacking force is applied as shown in FIG. 8*a* to FIG. 9*b*, it can be seen that a precise jacking force can be applied to the building 300 by using the method for calculating the jacking force of the present embodiment. Moreover, based on the building 300 and the weight variation of a load 400 applied thereon, a jacking force matched therewith can be precisely applied, which optimizes the reinforcement effect of the building 300.

The description above is merely the preferred embodiments of the present disclosure and shall not be used to limit the present disclosure. Any amendments, equivalent substitutions, improvements and so on within the spirit and principle of the present disclosure should be covered by the scope of protection of the present disclosure.

The invention claimed is:

1. A lightweight multifunctional supporting device, comprising a supporting frame and a jacking device, wherein the jacking device comprises screw rods and jacking seats, the screw rods are provided vertically and fixed on the supporting frame, each of the jacking seats is provided with a vertical threaded hole and provided with a lateral rotation rod, and the screw rods are in threaded connection with the threaded holes, wherein the supporting frame comprises at least one standard supporting frame, the standard supporting frame comprises at least four standard main upright rods distributed at four corners of the standard supporting frame, at least two standard lateral rods, a plurality of standard inclined rods, and first connecting elements with the first connecting elements fixed at two ends of the standard main upright rods, the standard main upright rods are provided vertically, the standard lateral rods are provided horizontally, and two ends of each of the standard lateral rods are each fixedly connected to two adjacent standard main upright rods, wherein one end of each of the standard inclined rods is fixed on a top of one standard main upright rod, and the other end of the standard inclined rod is fixed on a bottom of another standard main upright rod adjacent to the one standard main upright rod, and two standard main upright rods that are adjacent to each other up and down are removably connected through one of the first connecting elements.

2. A method for calculating a jacking force of the lightweight multifunctional supporting device of claim 1, comprising following steps:

A. pre-calculating, based on design, a jacking force P required to be applied to a position of a building to be jacked;

B. calculating a detection torque Tch=kPd by combining a pre-measured bolt torque coefficient k and a screw rod diameter d;

C. firstly screwing the screw rods into the jacking seats, and then mounting the screw rods onto a top face of the supporting frame;

D. placing the lightweight multifunctional supporting device below the position of the building to be jacked;

E. sheathing a rotational means capable of detecting the torque onto the rotation rod, such that the jacking seat is continuously moved upwards in a process of being screwed along the screw rod;

F. starting jacking up the building when the jacking seat is moved upwards a certain distance, wherein when a value of the torque detected by the rotational means is consistent with the calculated detection torque Tch, the jacking force applied by the jacking seat to the position of the building is the jacking force P required to be applied to the position of the building.

3. The lightweight multifunctional supporting device of claim 1, wherein a top of each of the jacking seats is planar.

4. The lightweight multifunctional supporting device of claim 1, wherein the supporting frame further comprises first fixing flanges, and a bottom of each of the screw rods is fixedly connected to the supporting frame through one of the first fixing flanges.

5. The lightweight multifunctional supporting device of claim 4, wherein the jacking device further comprises locking nuts, each of the locking nuts is sleeved on one of the screw rods and located between one of the first fixing flanges and one of the jacking seats.

6. The lightweight multifunctional supporting device of claim 1, wherein the supporting frame further comprises a top supporting frame, the top supporting frame is provided on the standard supporting frame, wherein the top supporting frame comprises top main upright rods distributed at four corners of the standard supporting frame, at least two top lateral rods, a plurality of top inclined rods, and second connecting elements with the second connecting elements fixed at two ends of the top main upright rod, wherein the top main upright rods are provided vertically, and the top lateral rods are provided horizontally, and two ends of each of the top lateral rods are fixedly connected to two adjacent top main upright rods, wherein one end of each of the top inclined rods is fixed on a top of one top main upright rod, and the other end of the top inclined rod is fixed on a bottom of another top main upright rod adjacent to the one top main upright rod, wherein the second connecting elements on top of the top main upright rods are removably connected to the screw rods, and the second connecting elements on a bottom of the top main upright rods are removably connected to the first connecting elements on the top of the standard main upright rods.

7. The lightweight multifunctional supporting device of claim 6, wherein the supporting frame further comprises adjustment rods provided between the standard supporting frame and the top supporting frame, upper and lower ends of each of the adjustment rods are both provided with a second fixing flange, and the standard supporting frame and the top supporting frame are connected through the second fixing flanges.

8. The lightweight multifunctional supporting device of claim 1, wherein the lightweight multifunctional supporting device further comprises a supporting base, and the supporting base is sandwiched between the jacking seats and a bottom face of a building.

* * * * *